US006000909A

United States Patent [19]

Hirokawa et al.

[11] Patent Number: 6,000,909

[45] Date of Patent: Dec. 14, 1999

[54] COOLING MEDIUM PATH IN GAS TURBINE MOVING BLADE

[75] Inventors: Kazuharu Hirokawa; Rintaro Chikami, both of Takasago; Tomoharu Matsuo, Tokyo, all of Japan

[73] Assignee: Mitsubishi Heavy Industries, Ltd., Tokyo, Japan

[21] Appl. No.: 09/027,191

[22] Filed: Feb. 20, 1998

[30] Foreign Application Priority Data

Feb. 21, 1997 [JP] Japan ..... 9-037648

[51] Int. Cl.[6] ..... F01D 5/08; F01D 5/18

[52] U.S. Cl. ..... 416/96 R; 416/95; 416/97; 416/96 A; 415/115

[58] Field of Search ..... 415/115; 416/95, 416/96 R, 97, 96 A

[56] References Cited

U.S. PATENT DOCUMENTS

| | | | |
|---|---|---|---|
| 2,931,623 | 4/1960 | Hyde | 416/92 |
| 2,974,925 | 3/1961 | Freche et al. | 415/117 |
| 3,370,830 | 2/1968 | Nickles et al. | 416/95 |
| 3,715,170 | 2/1973 | Savage et al. | 416/97 |
| 4,019,831 | 4/1977 | Franklin et al. | 416/97 R |
| 4,118,136 | 10/1978 | Corsmeier et al. | 403/386 |
| 4,136,516 | 1/1979 | Corsmeier | 60/39.09 |
| 4,344,738 | 8/1982 | Kelly et al. | 416/95 |
| 4,648,799 | 3/1987 | Brown et al. | 416/95 |
| 5,244,345 | 9/1993 | Curtis | 416/95 |
| 5,318,404 | 6/1994 | Carreno et al. | 416/96 R |
| 5,536,143 | 7/1996 | Jacala et al. | 416/96 R |

FOREIGN PATENT DOCUMENTS

| | | |
|---|---|---|
| 6-257403 | 9/1994 | Japan . |
| 2 224 082 | 4/1990 | United Kingdom . |

*Primary Examiner*—F. Daniel Lopez
*Assistant Examiner*—Rhonda Barton
*Attorney, Agent, or Firm*—Wenderoth, Lind & Ponack, L.L.P.

[57] ABSTRACT

A gas turbine moving blade having a cooling medium flow path constructed so that a concave spherical surface (C) is formed on a inside surface of an end portion of the cooling medium path (B) formed in a blade root portion. A hollow pipe (6) is provided in the cooling medium flow path between the blade root portion and a disc. The hollow pipe has a convex spherical surface (D) at one end thereof which engages the concave spherical surface (C) and the other end of the pipe has a convex spherical surface (F) which engages an inside surface of a cooling medium path (E) formed in the disc. The hollow pipe (6) provides communication between the cooling medium path (B) on the blade side and the cooling medium path (E) on the disc side. A supporting structure (7, 8, 9) is provided for holding the hollow pipe in the communicating position.

4 Claims, 5 Drawing Sheets

COOLING MEDIUM PATH IN GAS TURBINE MOVING BLADE

BACKGROUND OF THE INVENTION

1. Field of the Invention

The present invention relates to a cooling arrangement in a gas turbine moving blade in which the blade is cooled by a cooling medium supplied from an interior of a rotor into a cooling medium flow path.

2. Description of the Prior Art

A conventional gas turbine moving blade structure will be described with reference to FIGS. 3 and 4. FIG. 3 shows a gas turbine using air as the cooling medium, and illustrating an example of introducing cooling air into the gas turbine moving blade.

As indicated by arrows, cooling air flows through a cooling air pipe 51, passes through a hole 53 in a rotor disc 52, and then flows into a hollow moving blade 54 so as to cool the blade. Meanwhile, reference numeral 55 denotes a combustor and reference numeral 56 denotes an axial compressor. FIG. 4 shows an example of the moving blade having an internal cooling path.

Cooling air entering from a bottom portion of a blade root 71 flows in the direction indicated by the arrows so as to cool the moving blade. That is, cooling air entering from a leading edge side 72A flows in a cooling air flow path having a plurality of cooling fins 73 forming a turbulence promoter so as to cool the moving blade. Finally, the air flows out from a hole A on a blade top portion having a thinned tip portion 74 so that the air merges with the main gas flow.

On the other hand, in the direction indicated by arrows, cooling air entering from a trailing edge portion 72B flows in a cooling air path having a plurality of cooling fins 73. The air cools a blade trailing edge through pin fins 75. Then, the cooling air flows out from a plurality of holes B provided on the blade trailing end so that the cooling air merges with the main gas flow. Further, reference numeral 76 denotes a blade platform.

As described above, the conventional blade is constructed so that cooling air, transferred from the disc to the blade root, is used for cooling the moving blade and is finally discharged into the main gas flow.

In the aforementioned conventional structure, because the cooling air after cooling the moving blade is discharged into the main gas flow, the cooling air is a negative factor in terms of thermal efficiency of the turbine.

Further, in the air-cooled gas turbine, it is possible to enhance thermal efficiency by intensifying the sealing between the main gas flow and the interior of the rotor so as to block a back-flow of hot gas from a sealing portion and to minimize the amount of cooling air flowing into the main gas flow. Thus, an effective structure is that in which only the necessary amount of cooling air is fed to the moving blade so as to cool the blade while other air is fed to the sealing portion.

In recent years, steam has been more often used as the cooling medium instead of cooling air in order to raise the efficiency of the gas turbine. However, in such steam cooling, because extraction steam from a steam turbine composing a combined cycle, steam from a waste heat boiler or the like is used, and a complete elimination of leakage of cooling steam into the gas turbine is necessary for the reasons of the steam cycle such as supply of demineralized water, prevention of lowering of plant thermal efficiency and the like.

Thus, it is important that the cooling medium path is closed-relative to the outside so that only a supply port and a recovery port are provided thereby facilitating production thereof. Thus, the cooling medium path is generally designed so that the cooling medium is supplied from an axial end on the discharge side of the gas turbine rotor and is recovered at the axial end.

In both air cooling and steam cooling, it is important that the moving blade is adequately cooled without allowing the cooling medium to escape. Then, although it is absolutely necessary that in either air cooling or steam cooling, the cooling medium is adequately recovered, the conventional cooling medium path does not have an appropriate structure for reliably recovering the cooling medium.

Another problem associated with the conventional cooling medium path structure concerns a transfer position of the cooling medium between the disc and the blade root, that is, appropriate sealing performance at this location has not been secured due to the internal pressure of the cooling medium, the difference in thermal expansion between the disc and the blade root, the centrifugal force and the like.

SUMMARY OF THE INVENTION

Accordingly the present invention has been proposed to solve the problems in the prior art structure as mentioned above, and it therefore is an object of the present invention to provide a cooling medium flow path in a gas turbine moving blade in which the sealing performance thereof is substantially improved so as to block leakage of the cooling medium and thereby improving thermal efficiency of the gas turbine.

To achieve the object, the present invention provides a cooling medium path in a gas turbine moving blade which is so constructed as to be cooled by a cooling medium supplied to the blade from an interior portion of a rotor. A concave spherical surface is formed on an inside surface of an end portion of a cooling medium path in a blade root portion. Also provided is a hollow pipe in which one end thereof has a convex spherical surface which engages the concave spherical surface formed in the blade root portion. The other end of the pipe has a convex spherical surface which engages an inner peripheral surface of a cooling medium path formed in a rotor disc. Thus, the hollow pipe establishes communication between the cooling medium path on the blade side and the cooling medium path on the rotor disc side, while a supporting device is provided for holding the hollow pipe at a communicating position. According to this invention, because the hollow pipe communicating between the cooling medium path on the blade side and the cooling medium path on the rotor disc side is formed so that one end thereof has a convex spherical surface which engages the concave spherical surface of the inside surface of the cooling medium path on the blade side and the other end has a convex spherical surface which engages an inside surface of the cooling medium path on the rotor disc side, to establish fluid communication, the coupling of the spherical surface portions are further secured by the centrifugal force, the difference in thermal expansion and the like in the transfer of the cooling medium, so that the sealing performance is improved thereby and leakage of the cooling medium is blocked.

Further, because the coupling by the hollow pipe is conducted by spherical surface contacts, flexibility against relative deviations due to any processing errors of the rotor disc and the blade root and centrifugal force or heat during operation is secured so as to ensure an effective sealing performance at this transfer position thereby adequately preventing leakage.

DETAILED DESCRIPTION OF THE PREFERRED EMBODIMENTS

Figure 1:
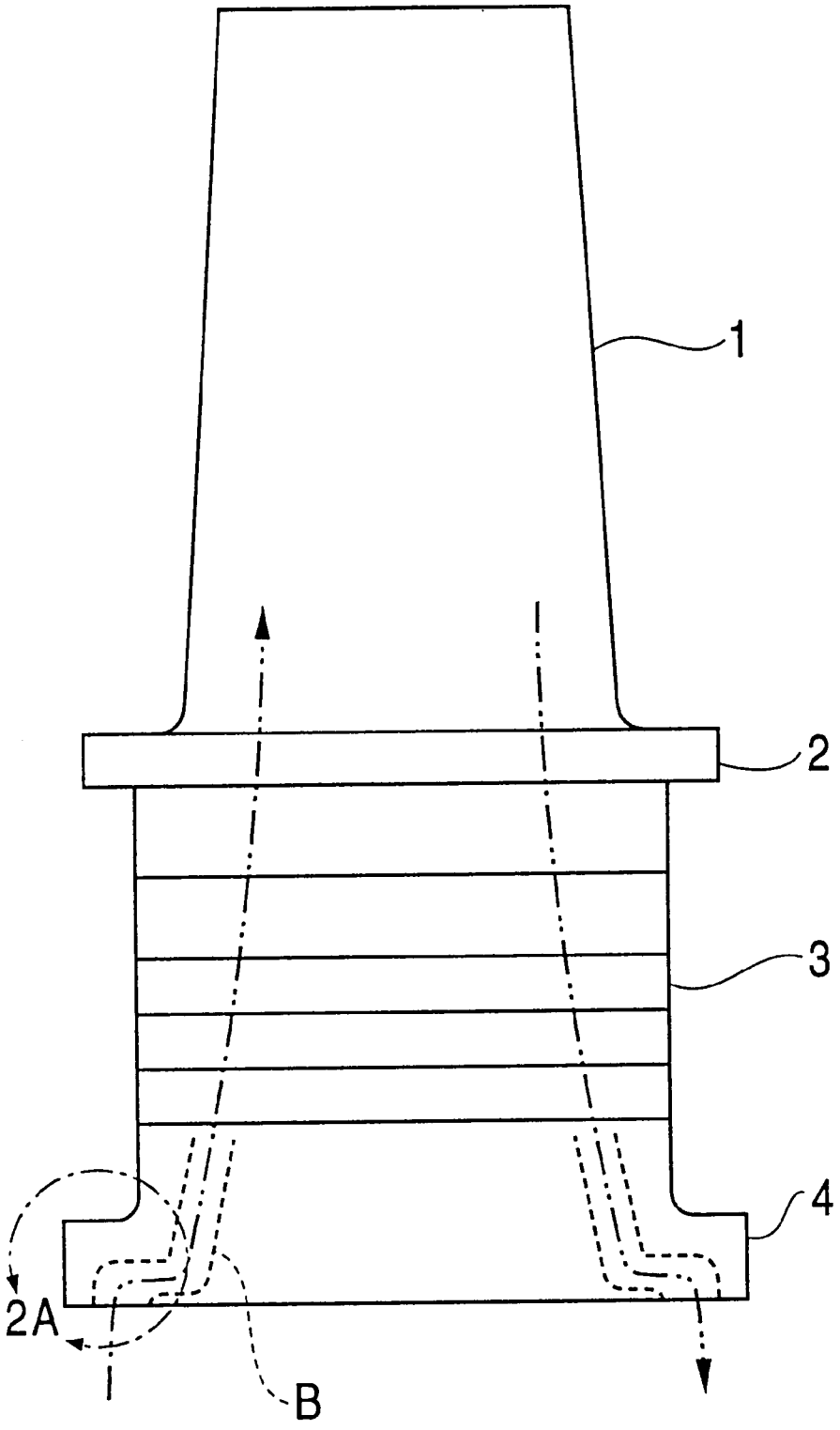
FIG. 1 is a front view of a gas turbine moving blade according to an embodiment of the present invention.

An embodiment of the present invention will be described with reference to FIGS. 1 and 2. FIG. 1 shows a front view of a moving blade which is a cooling medium recovery type, and FIG. 2 shows an enlarged view of portion A of FIG. 1.

The moving blade 1 is positioned on a blade platform 2 and a blade root 3 is located under the blade platform 2. Projecting portions 4 are provided on a supply side and a recovery side of the blade root 3 in the axial direction of a lowest portion of the blade root 3. A cooling medium path B is provided interiorly of the projecting portions 4 with both ends thereof being curved or bent, as shown by the broken lines. As indicated by the arrows, the cooling medium is fed to cool the interior of the hollow blade and blade root and then the cooling medium is recovered.

A detailed view of the projecting portion 4 for transferring the cooling medium to the aforementioned cooling medium path B will be described with reference to FIG. 2. The supply side will be described here and a description of the recovery side is omitted, however, the structure and function of both sides are the same.

Figure 2A:
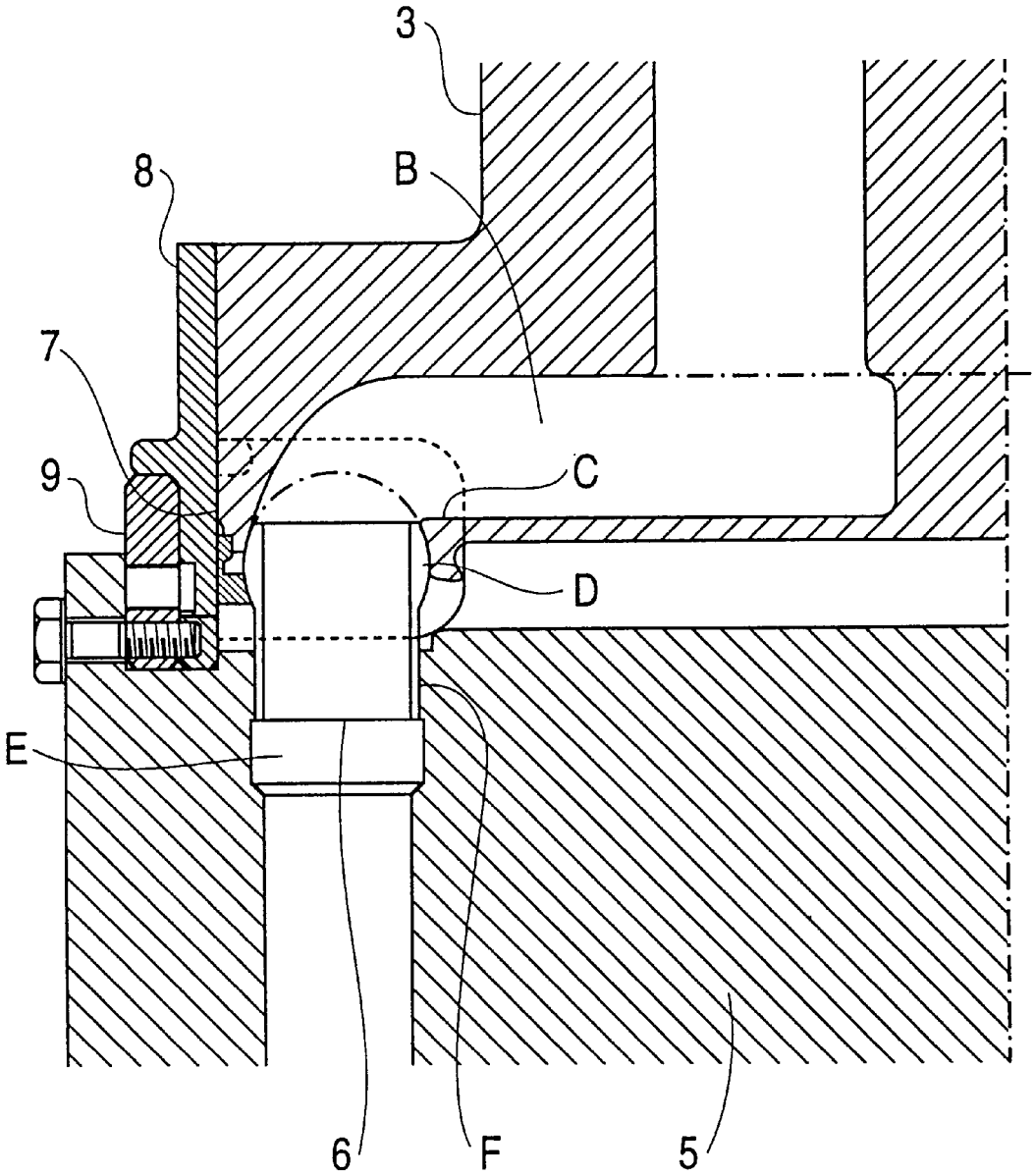
FIG. 2A is an enlarged cross sectional view of portion A of FIG. 1.
Figure 2B:
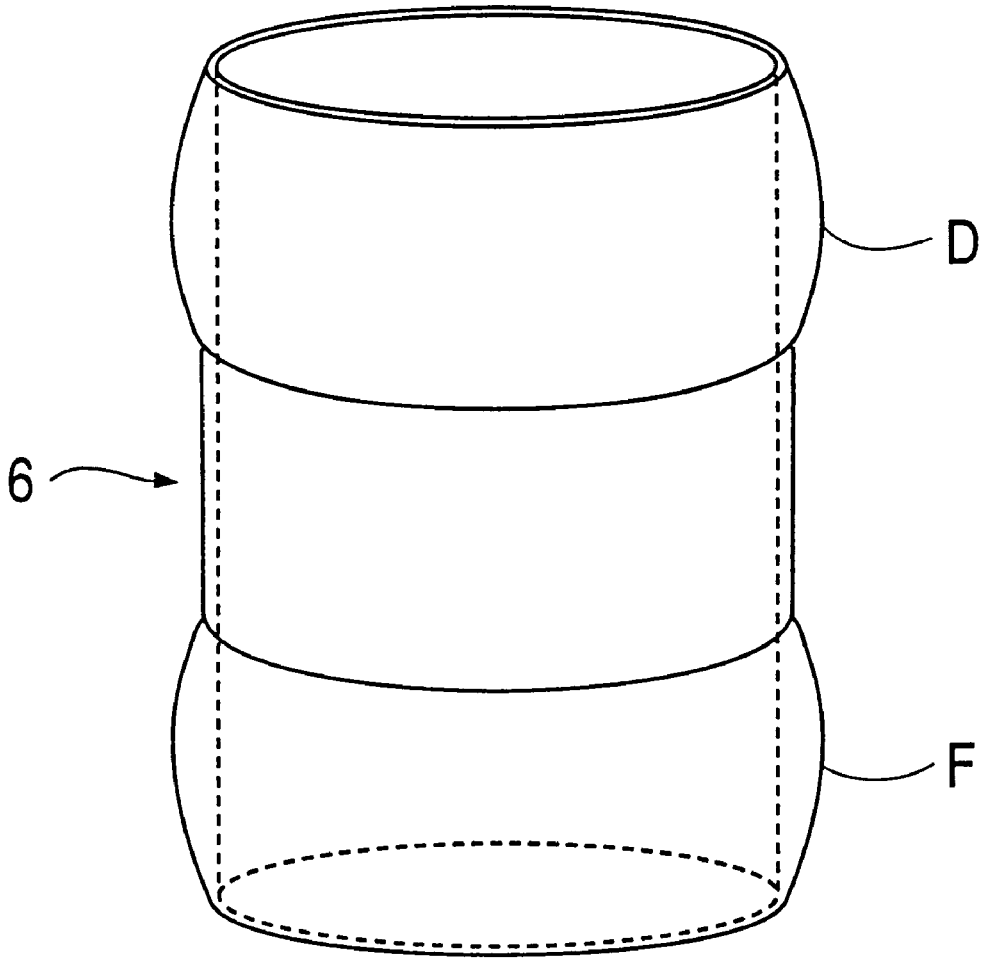
FIG. 2B is a perspective view of a hollow pipe used in the embodiment of FIG. 1.
Figure 3:
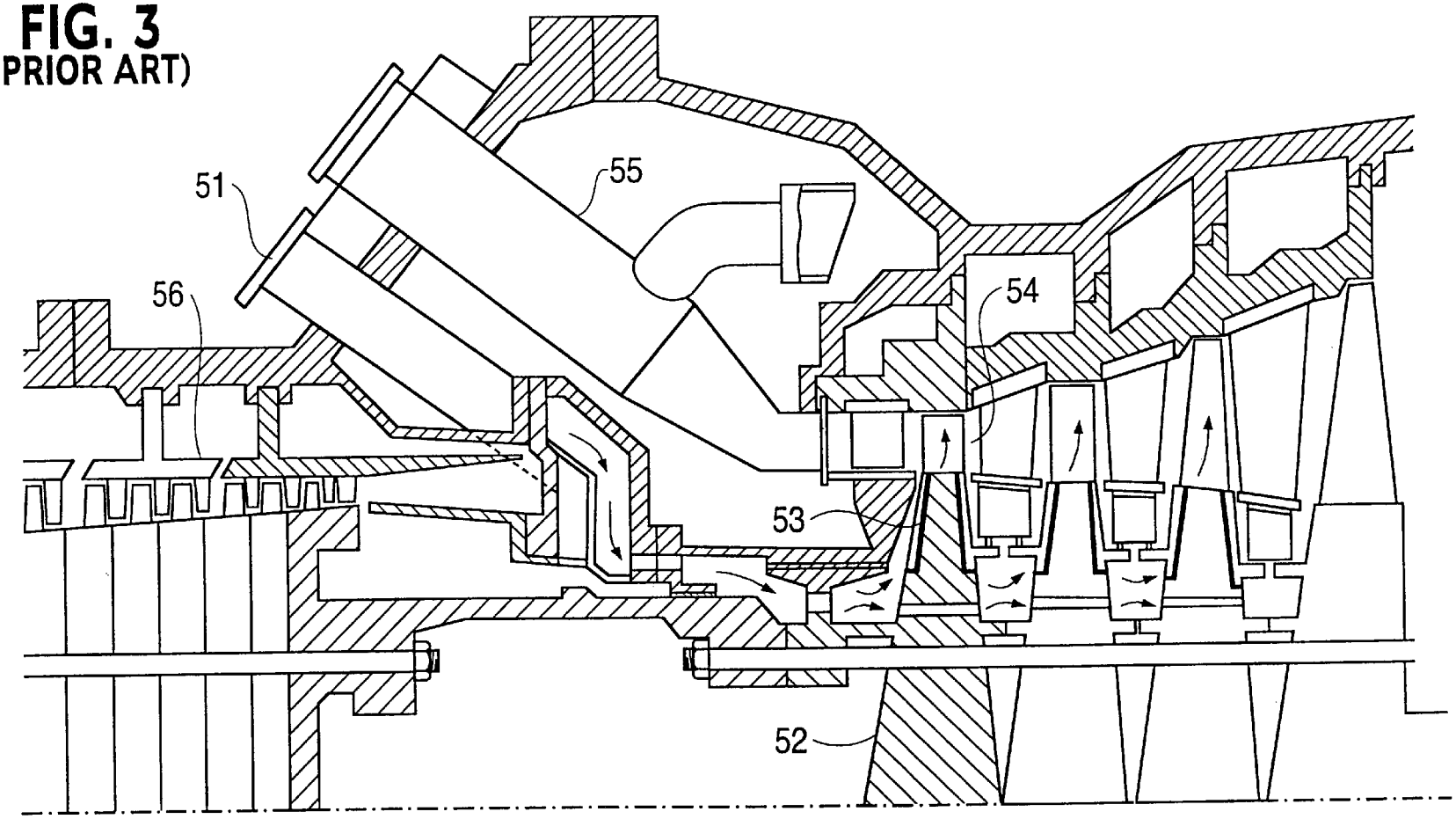
FIG. 3 (PRIOR ART)
FIG. 3 is an explanatory view showing a state of introduction of cooling medium in a conventional gas turbine.
Figure 4:
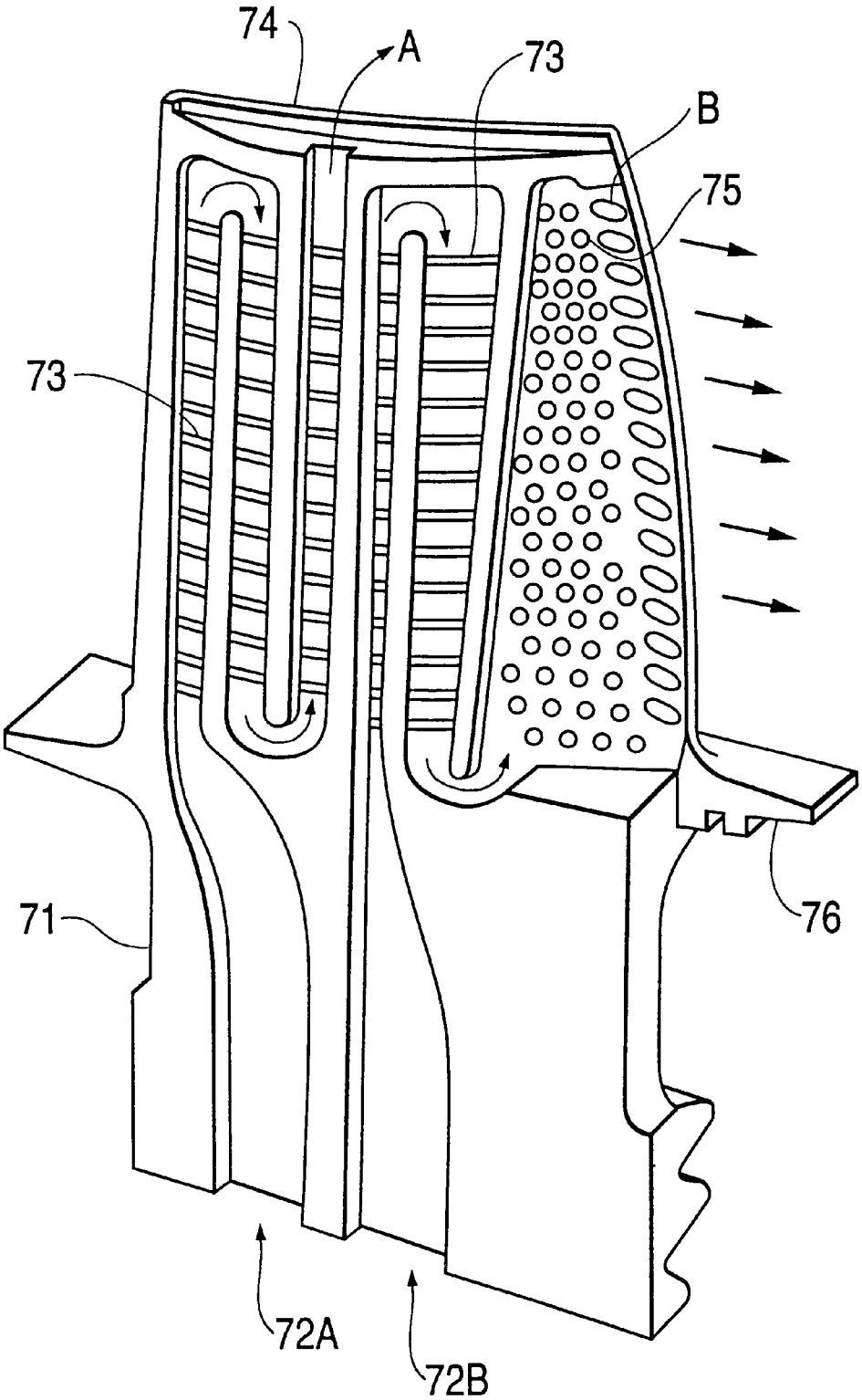
FIG. 4 (PRIOR ART)
FIG. 4 is an explanatory view showing a state of moving blade cooling in a conventional gas turbine.

Referring to FIG. 2, the portion A comprises a plurality of parts. An inside surface of an end portion (this is not necessarily a complete end but may include a portion slightly inward) of the cooling medium path B in the blade root 3 of the moving blade 1 is processed in the form of a concave spherical surface portion C. A hollow pipe 6, in which one end thereof has a convex spherical surface D, is inserted in this concave spherical surface. The other end of the hollow pipe has a convex spherical surface F, which is engaged in a cooling medium path E of a disc 5. FIG. 2B shows the contour of the outer peripheral surface of the hollow pipe 6.

The hollow pipe 6 is installed such that the convex spherical surface D is inserted in the concave spherical surface C of the blade root 3 via a supporting device comprising a metal pressing element 7, a pressing metal mounting plate 8, a side plate 9, etc. in this order from the side face of the end portion of the blade root 3 while the other end thereof is inserted in the cooling medium path E of the disc 5.

With this structure, leakage of the cooling medium at this transfer position due to internal pressure is prevented thereby improving the sealing performance. Further, because the hollow pipe 6 and blade root 3 are connected through spherical surface contact between the convex spherical surface D and concave spherical surface C, flexibility against relative deviations due to processing errors and centrifugal force or heat during operation is provided so as to ensure a secure seal at this transfer position thereby preventing leakage.

Although the embodiment of the present invention has been described above, the present invention is not restricted to this embodiment but it is needless to say that its structure may be modified in various ways within the scope of the present invention.

According to the present invention, a cooling medium path of a gas turbine moving blade, to be cooled by a cooling medium supplied thereinto from an interior of a rotor, is constructed so that a concave spherical surface is formed on an inside surface of an end portion of a cooling medium path formed in the blade root. Also provided is a hollow pipe, in which one end thereof has a convex spherical surface which engages the concave spherical surface and the other end has a convex spherical surface which engages an inside surface of a cooling medium path formed in the rotor disc. The hollow pipe establishes communication between the cooling medium path on the blade side and the cooling medium path on the rotor disc side, while a supporting device is provided for holding the hollow pipe at a communicating position.

Thus, the sealing performance is improved by the relationship between the convex spherical surface provided on the hollow pipe and the concave spherical surface provided in the cooling medium path and the like, so that the transfer of the cooling medium is performed without any leakage. Further, the cooling medium, which is used for cooling the disc and the blade is not discharged into the gas path but can be recovered outside of the gas turbine. As a result, for example, in a combined plant gas turbine, the thermal efficiency and a steam cycle efficiency of a steam turbine can be improved thereby making it possible to contribute to improvement of the thermal efficiency of the entire plant.

Also, according to the present invention, not only for the application to the recovery type steam-cooled gas turbine but also for the non-recovery type air-cooled gas turbine, air can be supplied to the moving blade only in the amount necessary for cooling the moving blade without leakage. Further, sealing air used for preventing the high temperature main gas flow from flowing into the interior of the rotor can be reduced. Thus, the amount of air flowing into the main gas flow can be reduced so that the thermal efficiency of the gas turbine can be improved.

What is claimed is:

1. A turbine blade cooling arrangement comprising:

a blade root portion having a cooling medium flow path which defines a concave spherical surface;

a disc having a cooling medium flow path; and a hollow pipe having a first convex spherical surface formed at a first end of said hollow pipe, and a second convex spherical surface formed at a second end of said hollow pipe, wherein said first convex spherical surface is in engagement with said concave spherical surface of said blade root portion, and said second convex spherical surface is in engagement with an inner peripheral surface of said cooling medium flow path of said disc.

2. The arrangement claimed in claim 1, further comprising a supporting structure for supporting said hollow pipe in contact with said concave spherical surface of said blade root portion.

3. A turbine blade cooling arrangement comprising:

a blade root portion having an upstream projection and a downstream projection formed on a lower portion of said blade root portion;

a supply cooling medium flow path formed in said upstream projection and defining a first concave spherical surface;

a recovery cooling medium flow path formed in said downstream projection and defining a second concave spherical surface;

a rotor disposed radially inward of said blade root portion and having a supply passage and a recovery passage formed therein;

a first hollow pipe establishing flow communication between said supply passage formed in said rotor and said supply cooling medium flow path formed in said upstream projection, said first hollow pipe having an outer peripheral surface defining a first convex spherical surface at one end of said first hollow pipe, and a second convex spherical surface formed at the other end of said first hollow pipe, wherein said first convex spherical surface of said first hollow pipe engages said first concave spherical surface of said blade root portion; and a second hollow pipe establishing flow communication between said recovery passage formed in said rotor and said recovery cooling medium flow path formed in said downstream projection, said second hollow pipe having an outer peripheral surface defining a first convex spherical surface at one end of said second hollow pipe, and a second convex spherical surface formed at the other end of said second hollow pipe, wherein said first convex spherical surface of said second hollow pipe engages said second concave spherical surface of said blade root portion.

4. The arrangement claimed in claim 3, further comprising a pair of supporting structures for supporting said first and second hollow pipes in engagement with said first and second concave spherical surfaces, respectively.

* * * * *